US007086704B2

(12) United States Patent
Holl et al.

(10) Patent No.: US 7,086,704 B2
(45) Date of Patent: Aug. 8, 2006

(54) FIXING DEVICE FOR A SHANK CHISEL

(75) Inventors: Bernd Holl, Neustadt-Borscheid (DE); Günter Tewes, Windhagen (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 10/514,392

(22) PCT Filed: Feb. 27, 2003

(86) PCT No.: PCT/EP03/02015

§ 371 (c)(1),
(2), (4) Date: Nov. 15, 2004

(87) PCT Pub. No.: WO03/098001

PCT Pub. Date: Nov. 27, 2003

(65) Prior Publication Data

US 2005/0150666 A1 Jul. 14, 2005

(30) Foreign Application Priority Data

May 15, 2002 (DE) ..... 102 21 764

(51) Int. Cl.
*E21C 35/193* (2006.01)

(52) U.S. Cl. ..... 299/102

(58) Field of Classification Search ..... 299/102–113
See application file for complete search history.

(56) References Cited

U.S. PATENT DOCUMENTS

| | | | | |
|---|---|---|---|---|
| 3,498,677 | A * | 3/1970 | Morrow | 299/102 |
| 3,904,247 | A * | 9/1975 | Ostrop | 299/103 |
| 4,057,294 | A | 11/1977 | Krekeler | |
| 4,076,318 | A * | 2/1978 | Hauschopp et al. | 299/103 |
| 4,275,929 | A * | 6/1981 | Krekeler | 299/102 |
| 5,322,351 | A * | 6/1994 | Lent | 299/102 |
| 5,378,050 | A * | 1/1995 | Kammerer et al. | 299/102 |
| 2003/0132660 | A1 * | 7/2003 | Holl et al. | 299/102 |

FOREIGN PATENT DOCUMENTS

| | | | |
|---|---|---|---|
| DE | G 94 11 545.1 | | 9/1994 |
| DE | 43 22 401 A1 | | 1/1995 |
| DE | 298 22 369 U1 | | 4/1999 |
| DE | 10261159 | * | 3/2004 |
| EP | 1 067 271 A1 | | 1/2001 |
| FR | 2 536 113 | | 5/1984 |
| WO | WO98/39553 | * | 9/1998 |
| WO | WO 2004/059128 | * | 7/2004 |
| WO | WO 2005/005119 | * | 1/2005 |

* cited by examiner

*Primary Examiner*—Sunil Singh
(74) *Attorney, Agent, or Firm*—Pauley Peterson & Erickson

(57) ABSTRACT

A fixing device for a shank chisel, having a base part and an upper part, wherein the upper part is detachably connected to the base part. The upper part has an opening for receiving a shank chisel and the base part has a shaft opening, into which a shaft of the upper part is inserted, and the shaft has a tensioning surface that rests against the counter surface of a clamping element. The clamping element has a tensioning screw which is used to clamp the tensioning surface against the counter surface. The base part has a shoulder surface, which is located in the vicinity of or near the shank opening and at least partially surrounds the shank opening. A stop surface adjoins the rear region of the shoulder surface in the infeed direction at an angle. The upper part rests on the stop surface by a supporting surface and is held at a distance, at least in sections, from the base part.

20 Claims, 2 Drawing Sheets

FIXING DEVICE FOR A SHANK CHISEL

BACKGROUND OF THE INVENTION

1. Field of the Invention

This invention relates to a holder for a shank chisel, which has a base element and an upper element, wherein the upper element can be releasably connected with the base element, the upper element has a receptacle for a shank chisel, the base element has a shank receiver into which the upper element is seated with the shank, and the shank has a bracing face, against which a bracing element rests with a counterface. The bracing element has a bracing screw by which the bracing face can be braced on the counterface, the base element has an offset face arranged near the shank receptacle and extends at least partially around the shank receptacle, wherein a detent face adjoins the offset face at an angle near the latter which lies in the rear with respect to the feed direction. The upper element is seated by a support face on the detent face and is held, at least partially, spaced apart from the base element near the offset face.

2. Discussion of Related Art

A holder for a shank chisel is known from German Patent Reference DE 43 22 401 A1. A base element is connected with a roller-shaped milling tube of a milling machine, preferably a road milling machine. An upper element is inserted with a shank into a shank receptacle of the base element.

The shank has a bracing face which is inclined relative to the insertion direction. The base element has a screw receiver, which extends into the shank receptacle. A bracing screw can be rotated into the screw receiver. On its end facing away from the screw head, the bracing screw has a counterface that can be braced together with the bracing face of the shank, so that the upper element is securely held in the base element. If too strong of a tightening torque is exerted on the bracing screw because of an operating error, the screw thread in the base element can sustain damage. Then, the base element has to be exchanged. During this, highly expensive down times of the machine are created because the base element is welded to the milling tube. It must be burned out and a new base element must be welded into position. It is necessary to keep the exact positioning of the new base element. The bracing screw is embodied as a pressure screw. With its end facing away from the screw head it rests on the bracing face of the shank and can undergo a mushroom-shaped flattening if there is too strong of a tightening torque. The danger of damage to the screw thread because of this deformation arises when the bracing screw is turned out and the base element would then be destroyed. The counterface of the bracing screw which is braced on the bracing face of the shank is relatively small. A strong surface pressure then results if there are impermissibly strong tightening torques. A bracing loss can occur as a result of settling of the material in the braced and threaded connection. Because of vibrations during the operation the danger then arises that the upper element is released and the lower element is damaged.

SUMMARY OF THE INVENTION

It is one object of this invention to provide a holder of the type mentioned above but with a more user-friendly, sturdy fastening of the upper element on the base element.

This object is achieved with a bracing element that has at least one displaceable wedge, which has at least one screw receiver for the bracing screw, and the bracing screw is supported on the upper element and is conducted through the support face and the detent face.

High bracing forces can be transmitted via the wedge of the bracing element to the shank of the upper element. Even if damage to the threaded connection exists, for example because of an operational error, it can be repaired without extensive down time of the machine. It is only necessary to exchange the wedge having the screw receiver. The use of the wedge makes the employment of a tension screw possible. There is an advantage in that a release of the screw connection is prevented, even under large mechanical loads on the upper element, and in particular in connection with vibrations. In this case the elasticity of the bracing screw allows compensation of settling without loss of bracing. Because the bracing screw passes through the detent face of the base element, a sturdy fastening results, along with a space-saving construction at the same time.

Optimally, in this arrangement the draw-in force transmitted to the upper element via the bracing screw is greater than the frictional force created between the wedge and the shank. Then the upper element is always held on the detent face of the base element, in a definite manner.

In one embodiment of this invention, the bracing element and the upper element are inserted into the wedge receiver and the shank receptacle from a top of the base element, and the bracing screw passes from the top of the base element through a screw receiver of the upper element. This arrangement allows a simultaneous positive and non-positive bracing of the wedge element, and therefore of the upper element.

For making possible a dependable and time-saving mounting of this arrangement, with the bracing screw the bracing element can be shifted in the wedge receiver between a release position, which releases the shank of the upper element, and a bracing position which fixes the shank in place. In the released position a limit face of the bracing element is in contact with a corresponding counterface of the wedge receiver, and the bracing screw is arranged so that its screw shank finds the screw receiver in the release position.

For providing a sufficient bracing effect, but simultaneously also the release of the wedge element without self-locking, an arrangement in accordance with this invention is such that the wedge angle ($\alpha$) of the bracing element is selected to lie in a range between 10° and 20°.

An especially compact construction can be achieved if the center longitudinal axis of the receptacle for the shank chisel intersects the center longitudinal axis of the bracing screw in the area of or near the screw shank.

In order to build up only the least possible surface pressures in the bracing connection, in accordance with this invention the wedge of the bracing element is supported flat with respect to the shank of the upper element and a wall of the bracing element receiver.

Thus the wall of the bracing element receiver and the bracing face toward the shank should be embodied as large as possible.

A satisfactory snug fit of the upper element results in particular if the shank of the upper element is a pentagonal shank in cross section and has five flat shank faces, and the bracing element can be braced with a counterface flat against one of the shank faces.

In one embodiment, wear can be distinguished if the center longitudinal axis of the bracing screw or a screw axis is arranged parallel with the longitudinal axis of the shank of the upper element.

To simply increase the effective contact faces between the shank and the bracing element, the bracing face of the shank can be convexly or concavely curved, and the counterface of the bracing element can be correspondingly embodied as concave or convex.

BRIEF DESCRIPTION OF THE DRAWINGS

This invention is explained in greater detail in view of an exemplary embodiment represented in the drawings, wherein.

DESCRIPTION OF PREFERRED EMBODIMENTS

Figure 1:
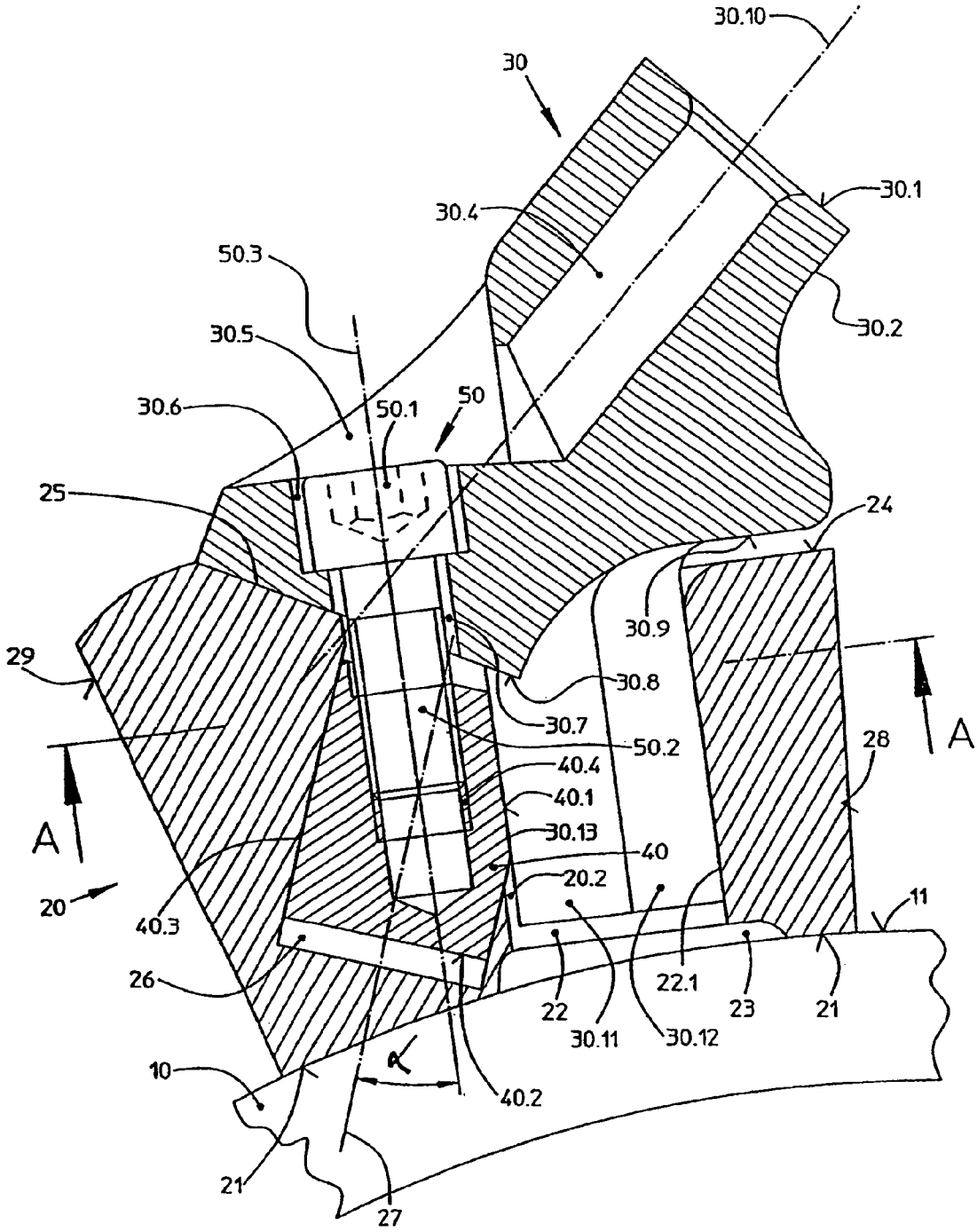
FIG. 1 is a lateral view in vertical section of a holder with a base element and an upper element.

A holder with a base element 20 and an upper element 30 is shown in FIG. 1. The base element 20 is placed with a lower seating face 21 on the surface 11 of a tubular roller 10. The base element 20 can be connected, for example welded together, with the tubular roller 10. Normally, a multitude of base elements are attached, lined up in a helical shape, to the tubular roller 10. For this purpose, line-up faces 28, 29 are on the base elements 20. The base element 20 has an offset face 24 which, when viewed in a feed direction, makes a transition at its back to the detent face 25. The detent face 25 extends at an angle with respect to the offset face 24. A shank receptacle 22 is cut into the offset face 24. The shank receptacle 22 terminates in a clearance space 23, which is set back with respect to the roller surface 11. The shank receptacle 22 is widened by a wedge receiver 26 having a size of a cross section that widens, starting at the offset face 24, in the direction toward the roller surface 11.

The upper element 30 can be fastened to the base element 20, which will be later explained in greater detail. The upper element 30 has a projecting shoulder 30.2, into which a bore as a chisel receiver 30.4 is cut, starting at a resting face 30.1. A round shank chisel, not represented in the drawings, can be inserted, rotatably seated, into the chisel receiver 30.4.

Here, the rotation of the round shank chisel occurs around the center axis 30.10. As FIG. 1 shows, the center axis 30.10 is placed at an acute angle.

To make the mounting of the round shank chisel easier, the chisel receiver 30.4 ends or terminates in an insertion widening in the area of the resting face 30.1. The chisel receiver 30.4 makes a transition into a recess 30.5 at the end facing away from the resting face 30.1.

A receiver 30.6 for the head of a bracing screw 50 is drilled into the upper element 30 in the area of or near the recess 30.5. The receiver 30.6 makes a transition into a screw receiver 30.7.

The upper element 30 has a support face 30.8 which is assigned to and rests against the detent face 25 of the base element 20. In the assembled state of the holder, the underside 30.9 of the upper element 30 is at distance from the offset face 24.

Starting at the underside 30.9, a shank 30.11 projects away from the upper element 30. The shank 30.11 is inserted into the shank receptacle 22 of the base element 20. Here, two front guide faces 30.12, which are arranged in a wedge shape with respect to each other, are supported on a corresponding centering device 22.1 of the base element 20, which is shown in greater detail in FIG. 2. On its rear and located opposite the bracing faces 30.12, the shank 30.11 has a flat guide face 30.13.

A bracing element 40 for holding the shank 30.11 in the shank receptacle 22 is braced against the guide face 30.13.

Figure 2:
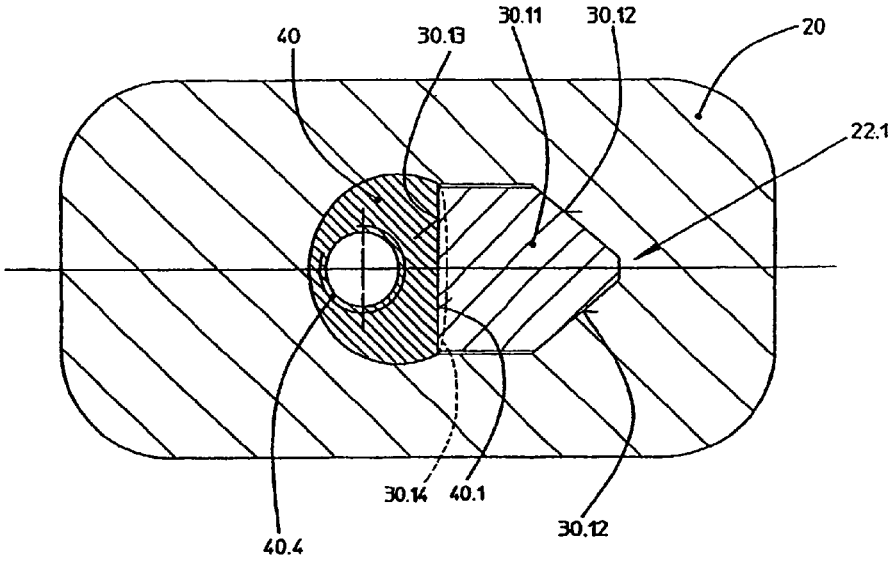
FIG. 2 is a section as shown in FIG. 1, taken along line A—A through a shank area of the upper element as shown in FIG. 1.

The bracing element 40 is embodied as a displaceable wedge and is introduced into the wedge receiver 26. The bracing element 40 can be moved back and forth in the wedge receiver 26 between a bracing and a release position by the bracing screw 50. The braced position is shown in FIG. 1. Here, the bracing element 40 rests with a counterface 40.1 on the bracing face 30.13 of the shank 30.11. In the release position, the bracing element 40 can be shifted in the wedge receiver 26 until it rests with its limit face 40.2 on the bottom of the wedge receiver 26. The displacement movement of the bracing element 40 is guided on the wall of the wedge receiver 26 and thus forms a sliding face 40.3. In one embodiment of this invention, the bracing face 30.13 of the shank 30.11 can be convexly or concavely curved, and the counterface of the bracing element 40 can be correspondingly embodied as concave or convex, as illustrated in FIG. 2 by a dashed line 30.14.

As mentioned above, the displacement of the bracing element 40 in the wedge receiver 26 is performed by the bracing screw 50. The bracing screw 50 is introduced into the screw receiver 30.7. The screw head 50.1 is protectively housed in the receiver 30.6. The screw shank 50.2 is passed through the screw receiver 30.7 and is screwed with a threaded section into a thread receiver 40.4 of the bracing element 40.

Starting at the released position, wherein the limit face 40.2 rests at the bottom of the wedge receiver 26, the bracing element 40 can be shifted along the longitudinal axis 27 as a result of the turning of the bracing screw 50. The longitudinal axis 27 extends at the wedge angle $\alpha$ with respect to the screw axis 50.3. The bracing element 40 can be shifted until it meets the bracing face 30.13 of the shank 30.11. Then the bracing element 40 presses the bracing faces 30.12 against the associated centering device 22.1 of the base element 20. The bracing element 40 is braced between the sliding face 40.3 and the bracing face 30.13. In the braced state the shank 30.11 is clear of the rear border of the shank receiver 22, so that a free space 20.2 results.

For disassembling the upper element 30 it is only necessary to release the bracing screw 50 and, if required such as due to self-locking, impeded by dirt or rust, etc., to bring it back with a light tap on the screw head 50.1 into the release position. Then the upper element 30 can be pulled out of the base element 20.

The invention claimed is:

1. A holder for a shank chisel having a base element (20) and an upper element (30), wherein the upper element (30) is releasably connected with the base element (20), the upper element (30) has a receiver (30.4) for a shank chisel, the base element (20) has a shank receptacle (22) into which the upper element (30) is seated with a shank (30.11) having a bracing face (30.13) against which a bracing element (40) rests with a counterface (40.1), the bracing element (40) having a bracing screw (50) for bracing the bracing face (30.13) on the counterface (40.1), the base element (20) has an offset face (24) arranged near the shank receptacle (22) and extending at least partially around the shank receptacle (22), a detent face (25) adjoins the offset face (24) at an angle which lies in a rear with respect to a feed direction, and the upper element (30) is seated by a support face (30.8) on the detent face (25) and is held, at least partially, spaced apart from the base element (20) near the offset face (24), the holder comprising:

the bracing element (40) having at least one displaceable wedge which has at least one screw receiver (40.4) for the bracing screw (50), and the bracing screw (50) supported on the upper element (30) and conducted through the support face (30.8) and the detent face (25).

2. The holder in accordance with claim 1, wherein the bracing element (40) is inserted into a wedge receiver (26) which adjoins the shank receptacle (22), that the shank (30.11) of the upper element (30) limits the wedge receiver (26) in a first direction toward the shank receptacle (22), and the wedge receiver (26) widens in a second direction toward the free end of the shank (30.11).

3. The holder in accordance with claim 2, wherein the bracing element (40) and the upper element (30) are inserted into the wedge receiver (26) and the shank receptacle (22) from a direction of a top of the base element (20), and the bracing screw (50) passes from the top of the base element (20) through a screw receiver (30.7) of the upper element (30).

4. The holder in accordance with claim 3, wherein with the bracing screw (50) the bracing element (40) is shiftable in the wedge receiver (26) between a release position which releases the shank (30.11) of the upper element (30) and a bracing position which fixes the shank (30.11) in place, that in the released position a limit face (40.2) of the bracing element (40) contacts a corresponding counterface of the wedge receiver (26), and the bracing screw (50) is arranged so that a screw shank (50.2) of the bracing screw (50) finds the screw receiver (40.4) in the release position.

5. The holder in accordance with claim 4, wherein a wedge angle ($\alpha$) of the bracing element (40) is in a range between 10° and 20°.

6. The holder in accordance with claim 5, wherein a first center longitudinal axis of the receiver (30.4) for a shank chisel intersects a second center longitudinal axis (50.3) of the bracing screw (50) near the screw shank (50.2).

7. The holder in accordance with claim 6, wherein the wedge of the bracing element (40) is supported flat with respect to the shank (30.11) of the upper element (30) and a wall of the wedge receiver (26).

8. The holder in accordance with claim 7, wherein that the shank (30.11) of the upper element (30) has a pentagonal cross section with five flat shank faces, and the bracing element (40) is braced with a counterface (40.1) flat against one of the flat shank faces.

9. The holder in accordance with claim 8, wherein a center longitudinal screw axis (50.3) of the bracing screw (50) is parallel to a longitudinal axis of the shank (30.11) of the upper element (30).

10. The holder in accordance with claim 9, wherein the center longitudinal screw axis (50.3) of the bracing screw (50) extends at an angle to a longitudinal axis of the bracing element (40).

11. The holder in accordance with claim 10, wherein the bracing face (30.13) of the shank (30.11) is one of convexly and concavely curved, and the counterface (40.1) of the bracing element (40) is correspondingly one of concave and convex.

12. The holder in accordance with claim 1, wherein the bracing element (40) and the upper element (30) are inserted into a wedge receiver (26) and the shank receptacle (22) from a direction of a top of the base element (20), and the bracing screw (50) passes from the top of the base element (20) through a screw receiver (30.7) of the upper element (30).

13. The holder in accordance with claim 12, wherein with the bracing screw (50) the bracing element (40) is shiftable in the wedge receiver (26) between a release position which releases the shank (30.11) of the upper element (30) and a bracing position which fixes the shank (30.11) in place, in the released position a limit face (40.2) of the bracing element (40) contacts a corresponding counterface of the wedge receiver (26), and the bracing screw (50) is arranged so that a screw shank (50.2) of the bracing screw (50) finds the screw receiver (40.4) in the release position.

14. The holder in accordance with claim 1, wherein a wedge angle ($\alpha$) of the bracing element (40) is in a range between 10° and 20°.

15. The holder in accordance with claim 1, wherein a first center longitudinal axis of the receiver (30.4) for a shank chisel intersects a second center longitudinal axis (50.3) of the bracing screw (50) near the screw shank (50.2).

16. The holder in accordance with claim 1, wherein the wedge of the bracing element (40) is supported flat with respect to the shank (30.11) of the upper element (30) and a wall of a bracing element receiver.

17. The holder in accordance with claim 1, wherein the shank (30.11) of the upper element (30) has a pentagonal cross section with five flat shank faces, and the bracing element (40) is braced with a counterface (40.1) flat against one of the flat shank faces.

18. The holder in accordance with claim 1, wherein a center longitudinal screw axis (50.3) of the bracing screw (50) is parallel to a longitudinal axis of the shank (30.11) of the upper element (30).

19. The holder in accordance with claim 1, wherein a center longitudinal screw axis (50.3) of the bracing screw (50) extends at an angle to a longitudinal axis of the bracing element (40).

20. The holder in accordance with claim 1, wherein the bracing face (30.13) of the shank (30.11) is one of convexly and concavely curved, and the counterface (40.1) of the bracing element (40) is correspondingly one of concave and convex.

* * * * *